US008787807B2

(12) United States Patent
Lin

(10) Patent No.: US 8,787,807 B2
(45) Date of Patent: Jul. 22, 2014

(54) PRINTER WITH LAMINATING FUNCTION

(75) Inventor: Kai-Wei Lin, New Taipei (TW)

(73) Assignees: Cal-Comp Electronics & Communications Company Limited, New Taipei (TW); Kinpo Electronics, Inc., New Taipei (TW)

( * ) Notice: Subject to any disclaimer, the term of this patent is extended or adjusted under 35 U.S.C. 154(b) by 0 days.

(21) Appl. No.: 13/565,803

(22) Filed: Aug. 3, 2012

(65) Prior Publication Data

US 2013/0089348 A1 Apr. 11, 2013

(30) Foreign Application Priority Data

Oct. 11, 2011 (TW) ..... 100136752 A

(51) Int. Cl.
*G03G 15/20* (2006.01)

(52) U.S. Cl.
USPC ..... 399/331; 399/342

(58) Field of Classification Search
USPC ..... 399/331, 342, 330, 341, 67, 328
See application file for complete search history.

(56) References Cited

U.S. PATENT DOCUMENTS

| | | | | |
|---|---|---|---|---|
| 6,751,436 | B2 | 6/2004 | Bhatti et al. | |
| 2004/0081494 | A1 | 4/2004 | Bhatti et al. | |
| 2005/0163522 | A1 * | 7/2005 | Carlson et al. | 399/67 |
| 2005/0214043 | A1 * | 9/2005 | Kameda | 399/328 |
| 2007/0110487 | A1 * | 5/2007 | Kim et al. | 399/328 |
| 2008/0056785 | A1 * | 3/2008 | Maruyama et al. | 399/342 |
| 2009/0016792 | A1 * | 1/2009 | Yamada et al. | 399/331 |

FOREIGN PATENT DOCUMENTS

| | | | | |
|---|---|---|---|---|
| CN | 101000485 | | 7/2007 | |
| JP | 02153381 A | * | 6/1990 | G03G 15/20 |
| TW | 577814 | | 3/2004 | |
| TW | I265857 | | 11/2006 | |

OTHER PUBLICATIONS

"Office Action of Taiwan Counterpart Application", issued on Nov. 21, 2013, p. 1-p. 7.
"Office Action of China Counterpart Application", issued on May 6, 2014, p. 1-p. 10.

* cited by examiner

*Primary Examiner* — Billy Lactaoen
(74) *Attorney, Agent, or Firm* — Jianq Chyun IP Office

(57) ABSTRACT

A printer having a body and a fixing mechanism is provided. The body has a first transporting track. The fixing mechanism has a heating mechanism and a pressurized mechanism, and the first transporting track is disposed between the heating mechanism and the pressurized mechanism. During a printing procedure, the heating mechanism provides a toner fixed temperature, and the pressurized mechanism provides a toner fixed pressure. During laminating procedure, the heating mechanism provides a laminating temperature, and the pressurized mechanism provides a laminating pressure. There is no additional laminating mechanism disposed inside the printer. The printer can execute a toner fixed function or a laminating function by adjusting the temperature and the pressure of the fixing mechanism originally disposed in the printer.

11 Claims, 5 Drawing Sheets

PRINTER WITH LAMINATING FUNCTION

CROSS-REFERENCE TO RELATED APPLICATION

This application claims the priority benefit of Taiwan application serial no. 100136752, filed on Oct. 11, 2011. The entirety of the above-mentioned patent application is hereby incorporated by reference herein and made a part of this specification.

BACKGROUND OF THE INVENTION

1. Field of the Invention

The invention relates to a printer, and more particularly, to a printer with a laminating function.

2. Description of Related Art

In offices today, printers and copiers are indispensable. When a document or photograph needs to be laminated, usually an additional laminating machine is used to perform lamination.

Laminating machines are not frequently used, and require a space to be placed. Thus, in order to save space, Taiwan Patent No. 1265857 discloses a printer combined with a laminating function. The aforementioned printer has two film rollers installed within specifically for laminating. After a document is fed into the printer, the document can be sent toward the two film rollers to perform laminating after printing or without printing. The printer can be used for only printing, only laminating, or both printing and laminating.

The printer respectively disposes two mechanisms for printing and laminating in the same body so that the printer can have both printing and laminating functions. Therefore, not only does the printer require a larger volume to store the printing and laminating structures, the production cost is also higher.

SUMMARY OF THE INVENTION

The invention provides a printer that utilizes a fixing mechanism originally in a body of the printer by adjusting a temperature and pressure of the fixing mechanism to execute a toner fix function or a laminating function.

The invention provides printer having a body, a printing mechanism, and a fixing mechanism. The body includes a first transporting track. The printing mechanism and the fixing mechanism are disposed in the body, and the fixing mechanism includes a heating mechanism and a pressurized mechanism. The first transporting track is disposed between the heating mechanism and the pressurized mechanism. The heating mechanism provides a toner fixed temperature or a laminating temperature, and the pressurized mechanism provides a toner fixed pressure or a laminating pressure.

Based of the above, the printer of the invention adjusts a temperature and pressure of a fixing mechanism to provide the conditions for executing a toner fix function or a laminating function. Since an additional laminating structure is not required, the printer not only maintains its original volume, but also does not require additional cost because of the new laminating function.

Several exemplary embodiments accompanied with figures are described in detail below to further describe the disclosure in details.

BRIEF DESCRIPTION OF THE DRAWINGS

The accompanying drawings constituting a part of this specification are incorporated herein to provide a further understanding of the invention. Here, the drawings illustrate embodiments of the invention and, together with the description, serve to explain the principles of the invention.

DESCRIPTION OF EMBODIMENTS

Figure 1:
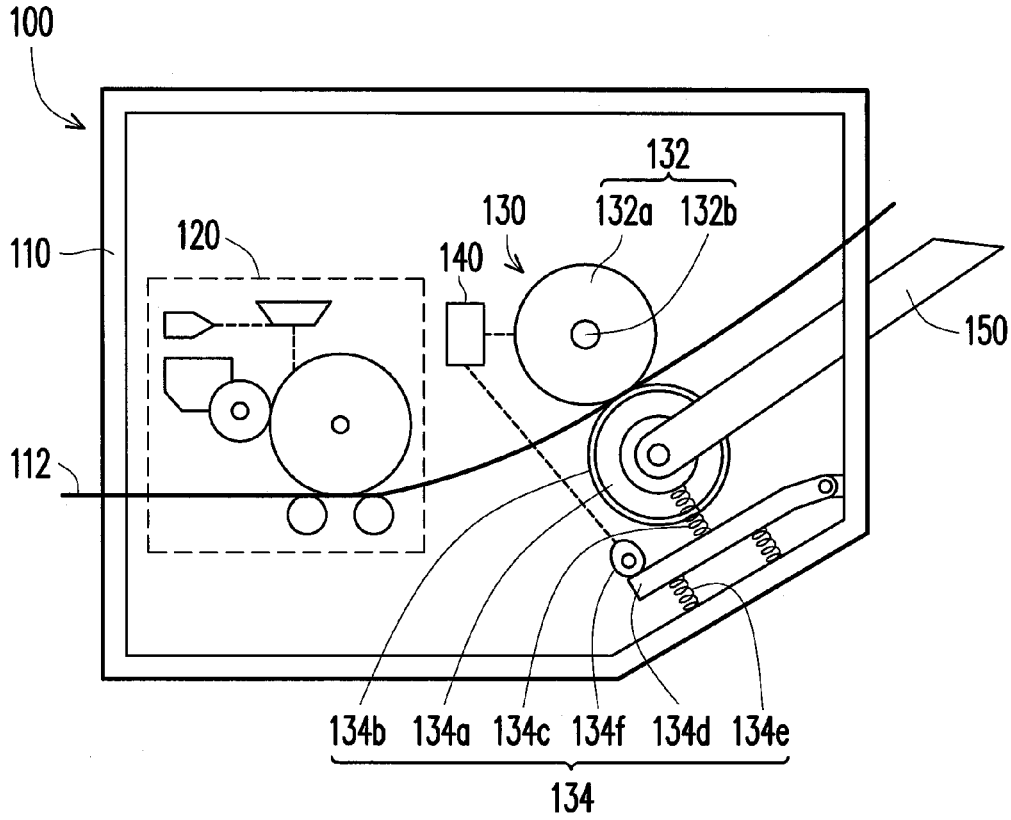
FIG. 1 is a schematic view of a printer according to an embodiment of the invention.

FIG. 1 is a schematic view of a printer according to an embodiment of the invention. A printer 100 of the embodiment includes a body 110, a printing mechanism 120, and a fixing mechanism 130. The body 110 includes a first transporting track 112. The printing mechanism 120 and the fixing mechanism 130 are disposed in the body 110. The first transporting track 112 respectively passes through the printing mechanism 120 and the fixing mechanism 130.

When the printer 100 executes a printing function, paper will transport from the first transporting track through the printing mechanism 120. When the paper passes through the printing mechanism 120, toner will adhere to the fibers of the paper. At this point, the toner on the paper will easily depart from its original position if affected by an external force. Thus, the paper that passed through the printing mechanism 120 will enter the fixing mechanism 130 so that the toner will fuse and permeate into the fibers of the paper. This way, the toner will be forever fixed onto the paper.

In the embodiment, the fixing mechanism 130 includes a heating mechanism 132 and a pressurized mechanism 134. The first transporting track 112 is located between the heating mechanism 132 and the pressurized mechanism 134. The heating mechanism 132 provides a toner fixed temperature or a laminating temperature according to need, and the pressurized mechanism 134 provides a toner fixed pressure or a laminating pressure according to need. The first transporting track 112 can transport objects that are to be printed or laminated, such as paper or films.

The user can first set to perform a printing procedure or a laminating procedure. When the user desires to use the printer 100 to perform the printing procedure, the user feeds paper into the printer 100, and the paper will first pass through the printing mechanism 120. Through the printing mechanism 120, toner is distributed on the paper. Then the paper enters the fixing mechanism 130, and the heating mechanism 132 provides a toner fixed temperature for the paper, and the pressurized mechanism 134 provides a toner fixed pressure for the paper. Through the fixing mechanism 130 heating and pressurizing the paper, the toner is fixed onto the paper.

When the user desires to use the printer 100 to perform the laminating procedure, the object to be laminated is covered with a film and fed into the printer. When performing the laminating function, the printing mechanism 120 does not operate. When the film passes through the fixing mechanism 130, the heating mechanism 132 provides a laminating temperature for the film, and the pressurized mechanism 134 provides a laminating pressure for the film. Through the fixing mechanism 130 heating and pressurizing the film, the lamination is complete. That is to say, the printer 100 of the invention adjusts a temperature and pressure of the fixing mechanism 130 according to need to complete a toner fix function or a laminating function.

In detail, the heating mechanism 132 includes a heating roller 132*a*. The heating roller 132*a* includes a heating tube 132*b*. The heating tube 132*b* is the heat source allowing the heating roller 132*a* to provide the toner fixed temperature or the laminating temperature. However, the heat source for the heating roller 132*a* is not limited thereto. In addition, the printer 100 includes a control module 140. The control module 140 is electrically connected to the heating mechanism 132, so as to control the heating mechanism 132 to provide the toner fixed temperature or the laminating temperature according to need.

The pressurized mechanism 134 includes a pressurized roller 134*a*, so that when the object to the printed or laminated passes through the fixing mechanism 130 through the first transporting track, it will be located between the heating roller 132*a* and the pressurized roller 134*a*. The printer 100 of the embodiment allows the object passing through to receive the toner fixed pressure or the laminating pressure through the pressurized roller 134*a* pressing against the heating roller 132*a*. In addition, the pressurized roller 134*a* includes an elastic surface layer 134*b*. An elasticity of the elastic surface layer 134*b* allows the pressing between the heating roller 132*a* and the pressurized roller 134*a* to be even tighter.

In the embodiment, the pressurized mechanism 134 further includes a first spring 134*c*, a base 134*d*, a second spring 134*e*, and a cam 134*f*. Two ends of the first spring 134*c* are respectively connected to the pressurized roller 134*a* and a side of the base 134*d*. The base 134*d* is hinged to the body 110. Two ends of the second spring 134*e* are respectively connected to the other side of the base 134*d* and the body 110. Since the cam 134*f* contacts the base 134*d*, rotating the cam 134*f* can adjust the position of the base 134*d*. This further adjusts the pressure the first spring 134*c* provides towards the pressurized roller 134*a*, so that the pressurized mechanism can provide the toner fixed pressure or the laminating pressure.

In the embodiment, the cam 134*f* can be rotated manually, so as to adjust the pressure provided by the pressurized mechanism 134. Of course, the control module 140 can also be electrically connected to the pressurized mechanism 134 to rotate the cam 134*f*, so as to change the pressure provided by the pressurized mechanism 134.

In addition, the printer of the embodiment further includes a rod 150, connected to the pressurized mechanism 134. When the object to be printed or laminated is jammed in the first transporting track 112 and lamination or printing can not be completed, the user can move the rod 150 so that the pressurized mechanism 134 can move to an open position relative to the heating mechanism 132. This way, the object to be printed or laminated can be taken out.

Figure 2:
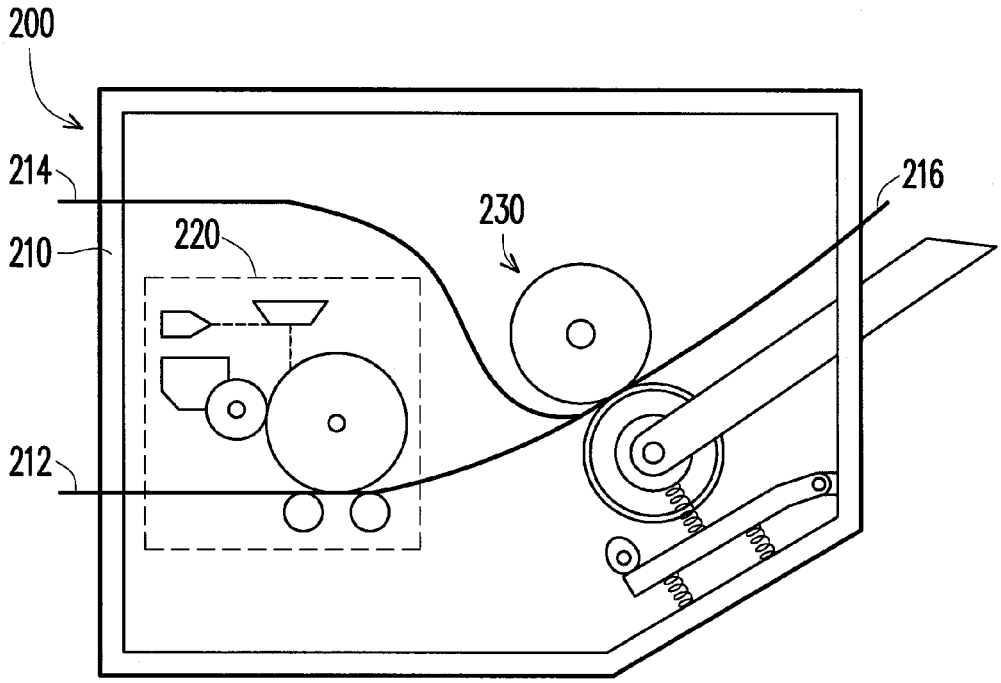
FIG. 2 is a schematic view of a printer according to another embodiment of the invention.

FIG. 2 is a schematic view of a printer according to another embodiment of the invention. A body 210 of a printer 200 of the embodiment includes a first transporting track 212 and a second transporting track 214. The second transporting track 214 passes through the fixing mechanism 230. The first transporting track 212 passes through the printing mechanism 220 and the fixing mechanism 230. As seen in FIG. 2, the first transporting track 212 meets with the second transporting track 214 before entering the fixing mechanism 230, and the first transporting track 212 and the second transporting track 214 will enter the fixing mechanism 230 as the same track to connect through an exit 216 of the body 210. The difference between the embodiment and the previous embodiment is in the embodiment of FIG. 1, regardless of executing a printing or laminating function, both use the first transporting track 112 to transport the object to be printed or laminated. As seen in FIG. 2, the track for executing the laminating function and the track for executing the printing function are separated. The second transporting track 214 is used as the track to transport film when executing the laminating function. The first transporting track 212 is used as the track to transport paper when executing the printing function.

Figure 3:
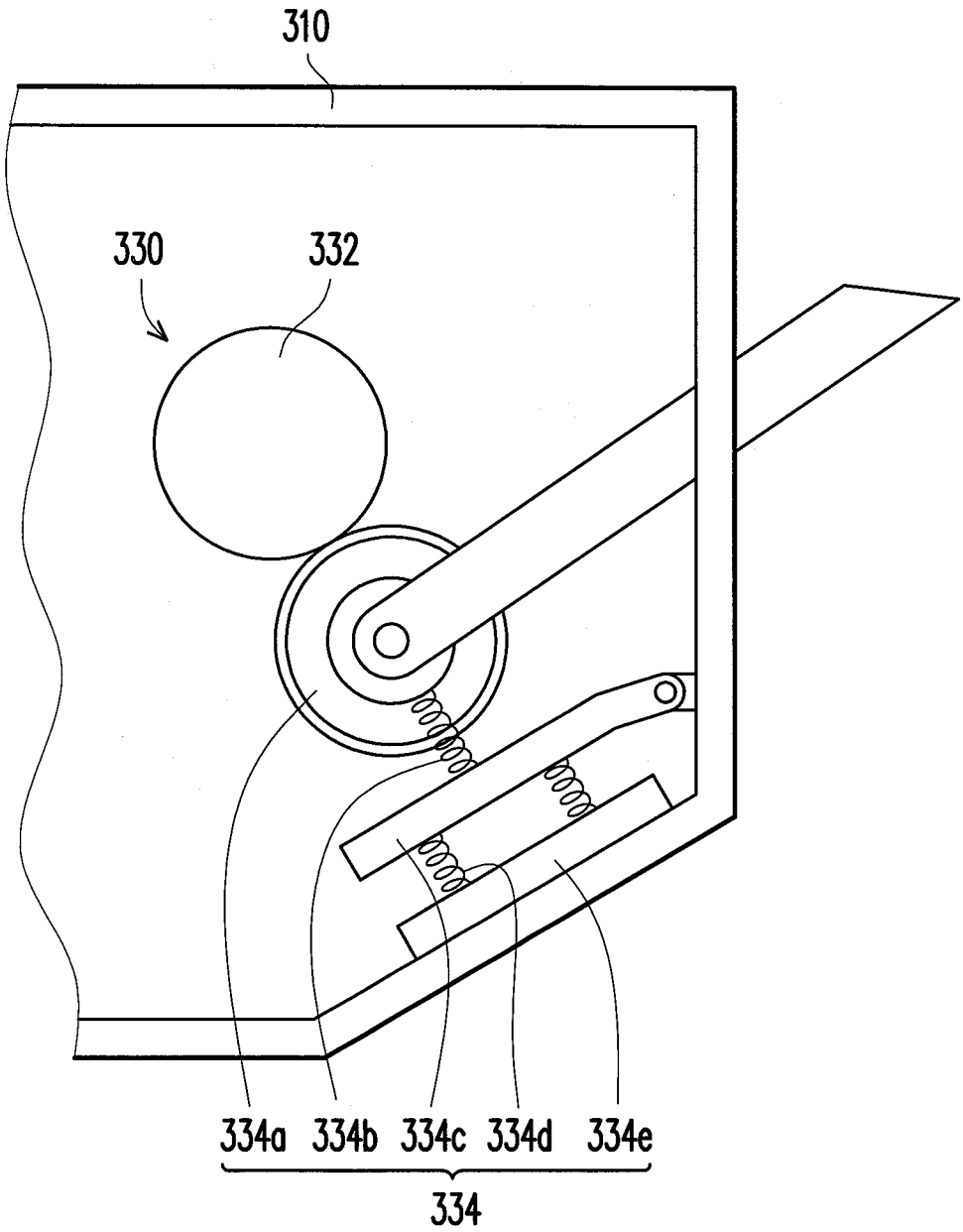
FIG. 3 is a schematic view of a fixing mechanism of a printer according to yet another embodiment of the invention.

FIG. 3 is a schematic view of a fixing mechanism of a printer according to yet another embodiment of the invention. The fixing mechanism 330 of the embodiment uses a magnetic method to provide pressure. In detail, the fixing mechanism 330 includes a heating mechanism 332 and a pressurized mechanism 334. The pressurized mechanism 334 includes a pressurized roller 334*a*, a first spring 334*b*, a magnetic base 334*c*, a second spring 334*d*, and an electromagnet 334*e*. Two ends of the first spring 334*b* are respectively connected to the pressurized roller 334*a* and a side of the magnetic base 334*c*. The magnetic base 334*c* is hinged to the body 310. Two ends of the second spring 334*d* are respectively connected to the other side of the magnetic base 334*c* and the body 310. The electromagnet 334*e* is disposed on the body 310 and corresponds to a position of the magnetic base 334*c*.

In the embodiment, the magnetic force of the electromagnet 334*e* is adjusted to change the distance between the magnetic base 334*c* and the electromagnet 334*e*. This way, the deformation of the first spring 334*b* is affected so as to further change the force applied towards the pressurized roller 334*a* by the first spring 334*b*. As a result, the pressurized mechanism 334 can provide a toner fixed pressure when printing, or a laminating pressure when laminating.

Figure 4:
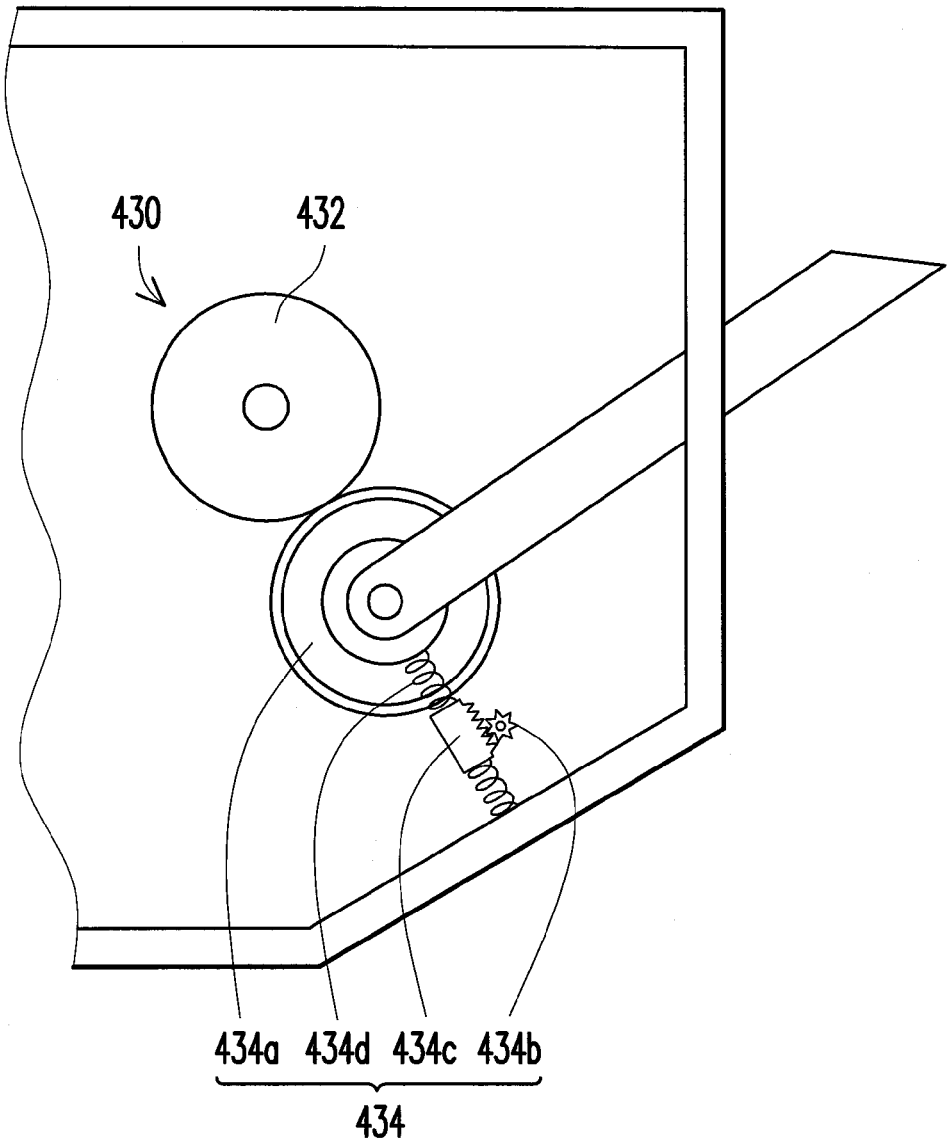
FIG. 4 is a schematic view of a fixing mechanism of a printer according to still another embodiment of the invention.

FIG. 4 is a schematic view of a fixing mechanism of a printer according to still another embodiment of the invention. In the embodiment, the fixing mechanism 430 uses a gear wheel and a rack to change pressure. The fixing mechanism 430 includes a heating mechanism 432 and a pressurized mechanism 434. The pressurized mechanism 434 includes a pressurized roller 434*a*, a gear wheel 434*b*, a rack 434*c*, and a spring 434*d*.

In the embodiment, the gear wheel 434*b* meshes with the rack 434*c*. Two ends of the spring 434*d* are respectively connected to the rack 434*c* and the pressurized mechanism 434. In the embodiment, a position of the gear wheel 434*b* in the printer does not change. Rotating the gear wheel 434*b* can change the position of the gear wheel 434*b* relative to the rack 434*c*. This changes the pressure applied to the spring 434*d* by the rack 434*c*, which causes the spring 434*d* to press against the pressurized roller 434*a* at a different pressure. As a result, the pressurized mechanism 434 of the embodiment can provide the toner fixed pressure or the laminating pressure.

Figure 5:
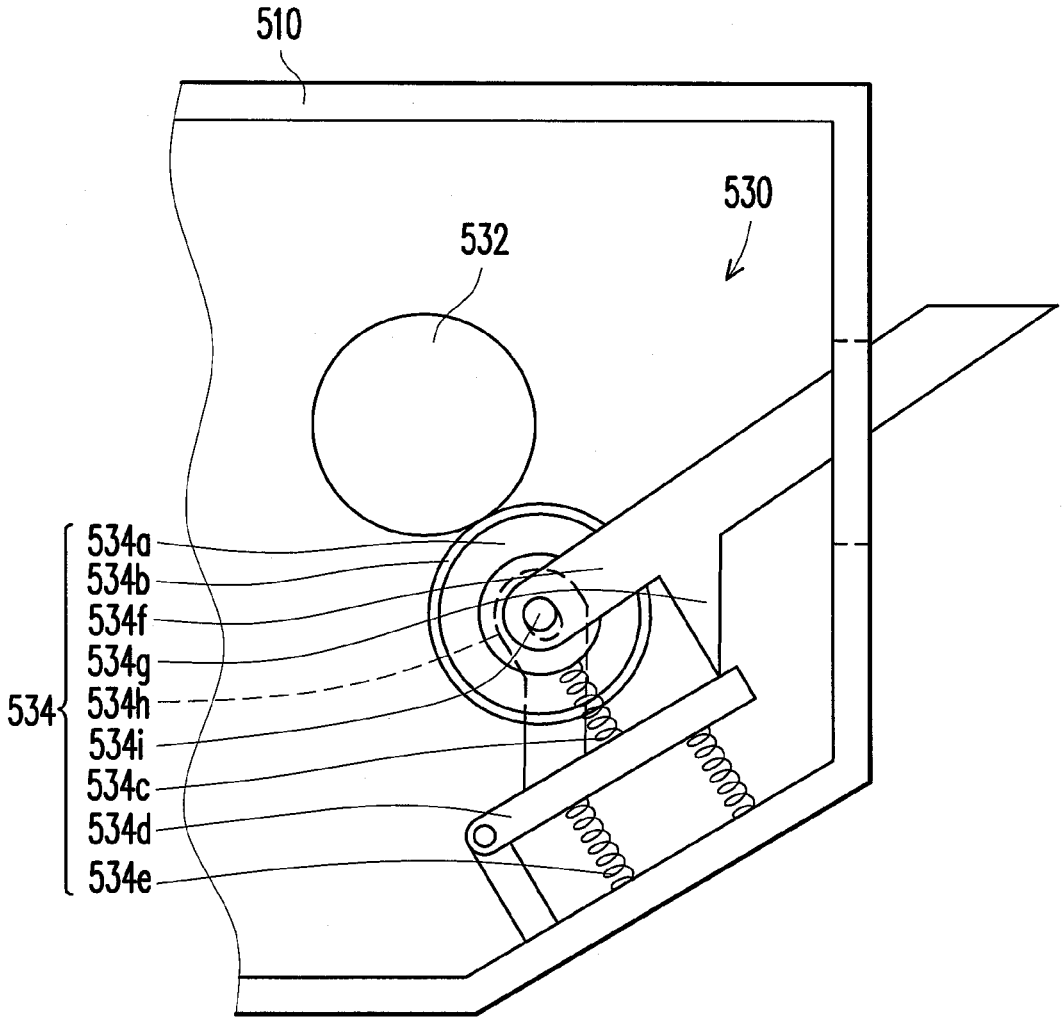
FIG. 5 is a schematic view of a fixing mechanism of a printer according to still another embodiment of the invention.

FIG. 5 is a schematic view of a fixing mechanism of a printer according to still another embodiment of the invention. Referring to FIG. 5, in the embodiment, the fixing mechanism 530 includes a heating mechanism 532 and a pressurized mechanism 534. The pressurized mechanism 534 includes a pressurized roller 534*a*, an elastic surface layer 534*b*, a first spring 534*c*, a base 534*d*, a second spring 534*e*, a rod 534*f*, and a restricting element 534*h*. The elastic surface layer 534*b* covers the pressurized roller 534*a*. Two ends of the first spring 534*c* are respectively connected to the pressurized roller 534*a* and a side of the base 534*d*. The base 534*d* is hinged to the body 510. Two ends of the second spring 534*e* are respectively connected to the other side of the base 534*d* and the body 510. An end of the rod 534*f* is hinged to the pressurized roller 534*a* by a pivot 534*i*. The other end of the rod 534*f* is located outside the body 510. The rod 534*f* includes a press portion 534*g*, wherein the press portion 534*g* presses against the base 534*d*. The restricting element 534*h* is fixed to the base 534*d* and the pivot 534*i* is located in the restricting element 534*h*. The restricting element 534 is used to restrict the movement distance of the pivot 534*i*.

When no pressure is applied to the rod 534*f*, a pressure exists between the pressurized roller 534*a* and the heating mechanism 532. Since the body 510 includes an opening 512 for the rod 534*f* to move up and down, in the embodiment, when an exposed portion of the rod 534*f* outside the body 510 is rotated up, the rod 534*f* is restricted by the opening 512 of the body 510 to only move a slight amount. At this point, the rod 534*f* will use the contact point with the body 510 as the fulcrum, so that the rod 534*f* located in the body 510 will move slightly downwards. Since the rod 534*f* is hinged with the pressurized roller 534*a*, the first spring 534*c* and the second spring 534*e* will slightly compress. Since the pressurized roller 534*a* includes the elastic surface layer 534*b*, even though the axis of the pressurized roller 534*a* is slightly away from the axis of the heating mechanism 532, the pressurized roller 534*a* still contacts the heating mechanism 532. Herein, the pressure between the pressurized roller 534*a* and the heating mechanism 532 is lowered. Thus, rotating the rod 534*f* can adjust the elasticity of the first spring 534*c* or the second spring 534*e* towards the pressurized roller 534*a*. This way the pressurized mechanism 534 can provide the toner fixed pressure or the laminating pressure.

In addition, if the paper or object is jammed by the pressurized roller 534*a* and the heating mechanism 532, in the embodiment, the portion of the rod 534*f* exposed outside the body 510 can be rotated downwards. Since the opening 512 of the body 510 allows the rod 534 to be rotated down, the press portion 534*g* will press down against the base 534*d* so that the second spring 534*e* is compressed. Since the pivot 534*i* between the pressurized roller 534*a* and the rod 534*f* is restricted by the restricting element 534*h*, the first spring 534*c* does not extend. Thus, in this condition, the pressurized roller 534*a* will move with the second spring 534*e* being compressed, away from the heating mechanism 532. This way the jammed paper can be removed.

To sum up, the printer of the invention adjusts a temperature and pressure of a fixing mechanism originally disposed in the printer to provide the conditions for executing a toner fix function or a laminating function. This way the printer of the invention does not require an additional laminating mechanism and can still simultaneously have both a printing function and a laminating function. Since an additional laminating mechanism is not required, the printer not only maintains its original volume, but also does not require additional cost because of the new laminating function.

Although the invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. A printer with laminating function, comprising:

a body, comprising a first transporting track;

a printing mechanism, disposed in the body; and a fixing mechanism, disposed in the body, the first transporting track passing through the fixing mechanism, the fixing mechanism comprising a heating mechanism and a pressurized mechanism, wherein the first transporting track is located between the heating mechanism and the pressurized mechanism, wherein when performing a printing procedure, the first transporting track, the heating mechanism provides a toner fixed temperature, and the pressurized mechanism provides a toner fixed pressure, and when performing a laminating procedure, the heating mechanism provides a laminating temperature, and the pressurized mechanism provides a laminating pressure, wherein the pressurized mechanism comprises a pressurized roller, and the pressurized roller comprises an elastic surface layer, the pressurized mechanism further comprises a first spring, a base, a second spring, and a rod, wherein two ends of the first spring are respectively connected to the pressurized roller and a side of the base, the base is hinged to the body, and two ends of the second spring are respectively connected to the body and the other side of the base, wherein the rod is hinged to the pressurized roller through a pivot and the other end of the rod is located outside the body, the rod includes a press portion, wherein the press portion presses against the base, and rotating the rod adjusts an elasticity of the first spring or the second spring applied to the pressurized roller, so that the pressurized mechanism provides the toner fixed pressure or the laminated pressure.

2. The printer with laminating function as claimed in claim 1, wherein the first transporting track meets with the second transporting track before passing through the fixing mechanism, and the first transporting track and the second transporting track pass through the fixing mechanism as the same track, and connect through an exit of the body.

3. The printer with laminating function as claimed in claim 1, wherein the heating mechanism comprises a heating roller, and the heating roller comprises a heating tube.

4. The printer with laminating function as claimed in claim 1, further comprising a control module, electrically connected to the heating mechanism, so as to control the heating mechanism to provide the toner fixed temperature or the laminating temperature.

5. The printer with laminating function as claimed in claim 4, wherein the control module is electrically connected to the pressurized mechanism, so as to control the pressurized mechanism to provide the toner fixed pressure or the laminating pressure.

6. The printer with laminating function as claimed in claim 1, further comprising a rod, connected to the pressurized mechanism, wherein moving the rod allows the pressurized mechanism to move to an open position relative to the heating mechanism.

7. The printer with laminating function as claimed in claim 1, wherein the pressurized mechanism further comprises a first spring, a base, a second spring, and a cam, wherein two ends of the first spring are respectively connected to the pressurized roller and a side of the base, the base is hinged to the body, and two ends of the second spring are respectively connected to the body and the other side of the base, wherein the cam contacts the base, and rotating the cam adjusts the elasticity applied towards the pressurized roller by the first spring, so that the pressurized mechanism provides the toner fixed pressure or the laminated pressure.

8. The printer with laminating function as claimed in claim 1, wherein the pressurized mechanism further includes a first spring, a magnetic base, a second spring, and an electromagnet, wherein two ends of the first spring are respectively connected to the pressurized roller and a side of the magnetic base, the magnetic base is hinged to the body, and two ends of the second spring are respectively connected to the body and the other side of the magnetic base, wherein the electromagnet is disposed on the body and corresponds to a position of the magnetic base, and a magnetic force of the electromagnet is adjusted so that the pressurized mechanism provides the toner fixed pressure or the laminated pressure.

9. The printer with laminating function as claimed in claim 1, wherein the pressurized mechanism further comprises a gear wheel, a rack, and a spring, the gear wheel meshes with the rack, wherein two ends of the spring are respectively connected to the rack and the pressurized mechanism, and the relative position between the gear wheel and the rack is adjusted so that the pressurized mechanism provides the toner fixed pressure or the laminated pressure.

10. The printer with laminating function as claimed in claim 1, wherein the pressurized mechanism further comprises a restricting element fixed to the base, and the pivot is located in the restricting element, wherein the restricting element is adapted to restrict a moving distance of the pivot.

11. The printer with laminating function as claimed in claim 1, further comprising a second transporting track transporting film when executing the laminating function, wherein the first transporting track transporting paper when executing the printing function and passing through the fixing mechanism and the printing mechanism, the second transporting track passing through the fixing mechanism and away from the printing mechanism.

* * * * *